US007871068B2

(12) United States Patent
Yamazaki

(10) Patent No.: US 7,871,068 B2
(45) Date of Patent: Jan. 18, 2011

(54) MEDIUM CONVEYING APPARATUS WITH MULTIPLE CONVEYING SECTIONS FOR CONTINUOUSLY CONTROLLED FEEDING OF A RECORD MEDIUM

(75) Inventor: Masato Yamazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 916 days.

(21) Appl. No.: 11/046,179

(22) Filed: Jan. 28, 2005

(65) Prior Publication Data

US 2005/0167904 A1 Aug. 4, 2005

(30) Foreign Application Priority Data

Jan. 30, 2004 (JP) ..... 2004-023459

(51) Int. Cl.
*B65H 5/00* (2006.01)

(52) U.S. Cl. ..... 271/10.03; 271/258.01; 271/265.01

(58) Field of Classification Search ..... 271/10.01, 271/10.03, 258.01, 265.01
See application file for complete search history.

(56) References Cited

U.S. PATENT DOCUMENTS

| | | | | |
|---|---|---|---|---|
| 4,444,382 | A * | 4/1984 | Ishikawa et al. | 271/10.03 |
| 5,192,067 | A * | 3/1993 | Saito | 271/10.03 |
| 5,749,569 | A * | 5/1998 | Atsumi et al. | 271/10.11 |
| 5,897,244 | A * | 4/1999 | Miyazaki et al. | 399/122 |
| 6,151,478 | A * | 11/2000 | Katsuta et al. | 399/372 |
| 6,757,515 | B2 * | 6/2004 | Ueda | 399/396 |
| 7,068,969 | B2 * | 6/2006 | Ueda | 399/388 |
| 2005/0012259 | A1 * | 1/2005 | Sano et al. | 271/10.01 |
| 2005/0104273 | A1 * | 5/2005 | Kim | 271/10.01 |
| 2005/0184443 | A1 * | 8/2005 | Satoh et al. | 271/10.01 |
| 2006/0180978 | A1 * | 8/2006 | Aoki et al. | 271/10.01 |

FOREIGN PATENT DOCUMENTS

| | | | |
|---|---|---|---|
| EP | 992860 | A2 * | 4/2000 |
| EP | 997788 | A2 * | 5/2000 |
| JP | 09-30667 | | 2/1997 |
| JP | 09-263336 | A | 10/1997 |
| JP | 2001-348129 | | 12/2001 |
| JP | 2002-19990 | | 1/2002 |

* cited by examiner

*Primary Examiner*—Gene Crawford
*Assistant Examiner*—Gerald W McClain
(74) *Attorney, Agent, or Firm*—Panitch Schwarze Belisario & Nadel LLP

(57) ABSTRACT

A medium conveying apparatus for conveying a recording medium includes an apparatus body and a conveying control unit. A paper feeding unit is detachable mounted to the apparatus body and includes a record medium enclosing section and a paper feeding section. First and second conveying sections are downstream from the paper feeding section. A third conveying section is between the paper feeding section and the first conveying section. The conveying control unit controls the third conveying section to convey the record medium before the front edge of the record medium arrives at the first conveying section, controls the first and the third conveying sections to convey the record medium before the front edge of the record medium arrives at the second conveying section and stops the third conveying section from operating after the front edge of the record medium arrives at the second conveying section.

10 Claims, 13 Drawing Sheets

MEDIUM CONVEYING APPARATUS WITH MULTIPLE CONVEYING SECTIONS FOR CONTINUOUSLY CONTROLLED FEEDING OF A RECORD MEDIUM

BACKGROUND OF THE INVENTION

1. Field of the Invention

The invention relates to a medium conveying apparatus.

2. Related Background Art

Hitherto, in an image forming apparatus such as printer, copying apparatus, facsimile apparatus, or the like, as a medium conveying apparatus for conveying a recording medium to an image forming unit, one recording medium is separated from a plurality of recording media stacked and enclosed on a medium tray, fed out, and thereafter, conveyed by conveying rollers as a plurality of conveying units.

To separate one recording medium from the plurality of stacked recording media and feed it out, when a paper feed roller is pressed toward a front edge portion of the top recording medium and the paper feed roller is rotated by a driving force transfer unit having a one-way clutch, the top recording medium is fed out, the front edge of the recording medium passes through the conveying roller arranged on the downstream side from the paper feed roller, and thereafter, the driving of the paper feed roller is stopped.

After the driving of the paper feed roller is stopped, the recording medium which is conveyed by the conveying rollers drives the paper feed roller. When a rear edge of the recording medium passes through the paper feed roller, the paper feed roller is stopped, and the recording medium is separated (for example, refer to JP-A-9-263336).

FIG. 2 is a perspective view showing a main section of the conventional medium conveying apparatus. FIG. 3 is a perspective view showing a main section of another conventional medium conveying apparatus.

In FIG. 2, F denotes a supporting frame and reference numeral 15 denotes a first conveying roller unit rotatably supported to the supporting frame F. The first conveying roller unit 15 comprises a conveying roller 101 and a pinch roller 102. The conveying roller 101 comprises rubber rollers 103 arranged in predetermined positions of a shaft sh1. Reference numeral 16 denotes a second conveying roller unit rotatably supported to the supporting frame F. The second conveying roller unit 16 comprises a conveying roller 104 and a pinch roller 105. A recording medium (not shown) is supplied to the first conveying roller unit 15 in the direction shown by an arrow A, ejected from the first conveying roller unit 15, thereafter, guided by a curved guide 108, supplied to the second conveying roller unit 16, and ejected from the second conveying roller unit 16 in the direction shown by an arrow B.

Although a paper feed roller (not shown) is arranged on the upstream side from the first conveying roller unit 15 in the conveying direction of the recording medium, as mentioned above, when the rotation of the paper feed roller is stopped, the first conveying roller unit 15 needs to solely convey the recording medium in the state where loads of the paper feed roller and other devices have been applied.

As shown in FIG. 2, however, since the rubber roller 103 is small, a conveying force of the recording medium cannot be increased in the conveying roller 101. Therefore, as shown in FIG. 3, a rubber roller 113 is enlarged so as to sufficiently assure an area touch the recording medium, thereby increasing the conveying force of the recording medium.

However, in the conventional medium conveying apparatus, since an amount of rubber material which is used is increased by an enlargement amount of the rubber roller 113, costs rise.

SUMMARY OF THE INVENTION

It is an object of the invention to provide a medium conveying apparatus which can solve the problem of the conventional medium conveying apparatus as mentioned above, smoothly convey a recording medium in a conveying unit, and reduce costs.

According to the present invention, there is provided a medium conveying apparatus comprising:

- a recording medium enclosing unit which encloses a plurality of recording media;
- a paper feeding unit which feeds out the recording media in the recording medium enclosing unit;
- a first conveying unit which is arranged on the downstream side from the paper feeding unit and conveys the fed-out recording medium;
- a second conveying unit which is arranged on the downstream side from the first conveying unit;
- a medium front edge detecting unit which detects a front edge of the recording medium which is being conveyed; and
- a operation stopping unit which stops the operation of the paper feeding unit at predetermined timing.

In the medium conveying apparatus, the operation stopping unit stops the operation of the paper feeding unit after the front edge of the recording medium passed through the second conveying unit.

Moreover, The medium conveying apparatus may further comprise a third conveying unit which is arranged between the paper feeding unit and the first conveying unit, and wherein the operation stopping unit stops the operation of the third conveying unit at predetermined timing.

Moreover, the operation stopping unit may stop the operation of the paper feeding unit after the front edge of the recording medium passed through the second conveying unit and stops the operation of the third conveying unit.

Moreover, the operation stopping unit may stop the operation of the paper feeding unit after the front edge of the recording medium passed through the third conveying unit and stops the operation of the third conveying unit after the front edge of the recording medium passed through the second conveying unit.

Moreover, the medium conveying apparatus may further comprise a medium length detecting unit which detects a length of recording medium in the recording medium enclosing unit, and wherein the operation stopping unit stops the operation of the paper feeding unit after the front edge of the recording medium passed through the third conveying unit and stops the operation of the third conveying unit after the recording medium was conveyed by a distance corresponding to the length of recording medium detected by the medium length detecting unit after the front edge of the recording medium had passed through the third conveying unit.

Moreover, the medium conveying apparatus may further comprise a medium rear edge detecting unit which detects a rear edge of the recording medium which is being conveyed, and wherein the operation stopping unit stops the operation of the paper feeding unit after the front edge of the recording medium passed through the third conveying unit and stops the operation of the third conveying unit after the rear edge of the recording medium passed through the third conveying unit.

Moreover, in the medium conveying apparatus, the third conveying unit has two rollers which face each other, a pressing member for pressing one of the rollers to the other roller, and a driving unit for rotating at least one of the rollers, and the operation stopping unit stops the operation of the paper feeding unit after the front edge of the recording medium passed through the third conveying unit, cancels a pressing force to the pressing member after the front edge of the recording medium passed through the first conveying unit, and applies the pressing force to the pressing member after a rear edge of the recording medium passed through the third conveying unit.

That is, according to the invention, the medium conveying apparatus comprises: the recording medium enclosing unit which encloses a plurality of recording media; the paper feeding unit which feeds out the recording media in the recording medium enclosing unit; the first conveying unit which is arranged on the downstream side from the paper feeding unit and conveys the fed-out recording medium; the second conveying unit which is arranged on the downstream side from the first conveying unit; the medium front edge detecting unit which detects the front edge of the recording medium which is being conveyed; and the operation stopping unit which stops the operation of the paper feeding unit at the predetermined timing.

In this case, since the front edge of the recording medium which is being conveyed is detected and the operation of the paper feeding unit is stopped at the predetermined timing, a load which is applied to the first conveying unit can be reduced and the recording medium can be smoothly conveyed by the first conveying unit.

Since the load which is applied to the first conveying unit can be reduced, there is no need to enlarge a rubber roller of the first conveying unit. Therefore, the costs of the medium conveying apparatus can be reduced.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings. In this case, a printer as an image forming apparatus will be described.

Figure 4:
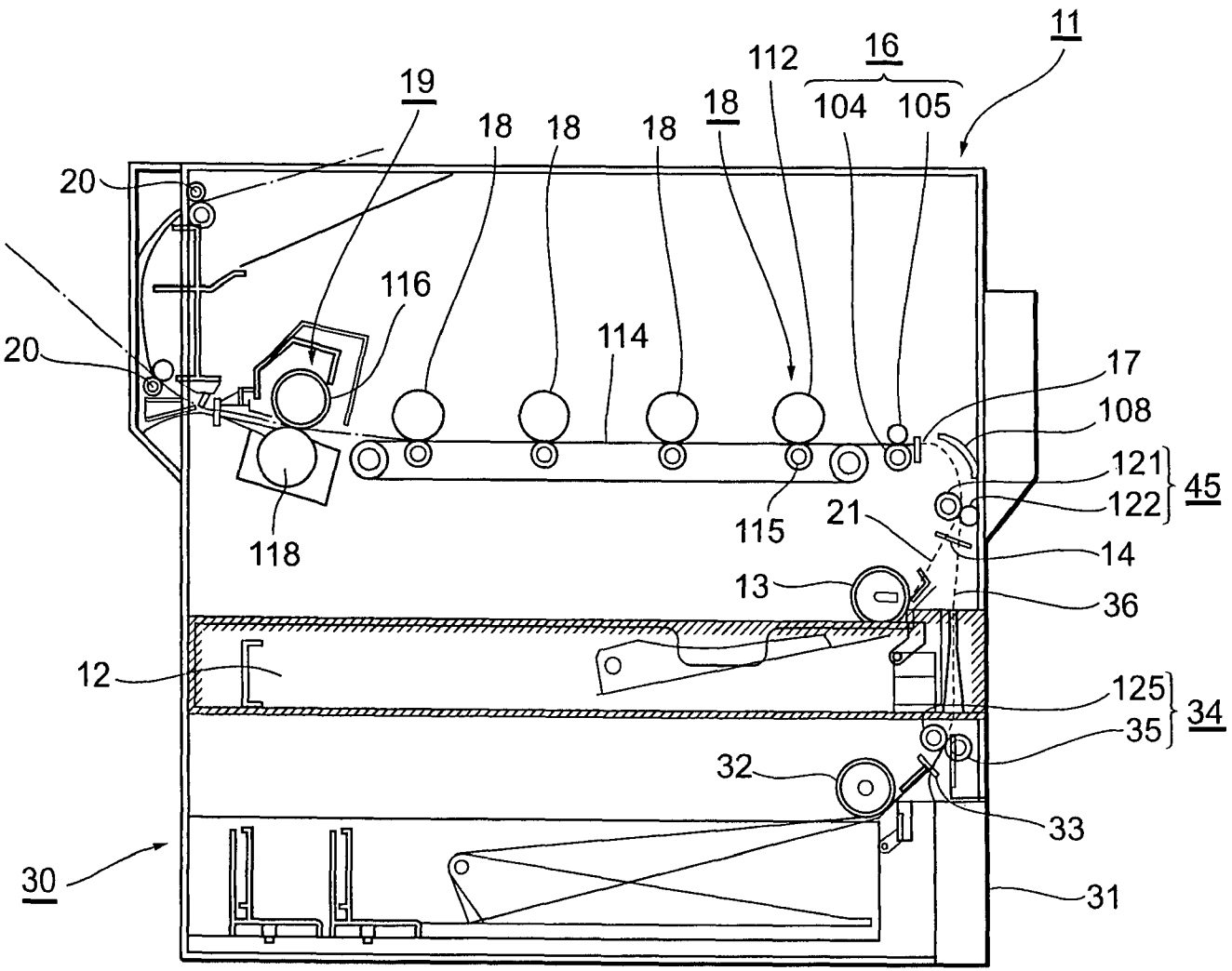
FIG. 4 is a schematic diagram of a printer in the first embodiment of the invention.

FIG. 4 is a schematic diagram of the printer in the first embodiment of the invention.

In the diagram, reference numeral 11 denotes a printer main body showing an apparatus main body; 12 a sheet cassette as a recording medium enclosing unit for enclosing recording media (not shown) such as paper, OHP sheets, or the like; and 13 a paper feed roller as a first paper feeding unit for feeding out the recording media in the sheet cassette 12 one by one. The paper feed roller 13 has a one-way clutch function and propagates a rotating force only to one direction. The paper feed roller 13 is raced in the opposite direction and does not propagate the rotating force.

Reference numerals 14 and 17 denote medium sensors as first and second detecting units serving as first and second medium front edge detecting units for detecting a front edge of the recording medium in order to recognize passage of the recording medium; 45 a first conveying roller unit having functions of conveying the recording medium fed out of the sheet cassette 12 and correcting a skew of the recording medium; 108 the guide for deflecting the recording medium ejected from the first conveying roller unit 45 and guiding it in the horizontal direction; and 16 the second conveying roller unit for supplying the recording medium guided by the guide 108 to each image forming unit 18.

Reference numeral 30 denotes an optional paper feed tray unit which is detachably arranged to/from the printer main body 11; 31 a sheet cassette as a recording medium enclosing unit for optional paper feeding; and 32 a paper feed roller as a second paper feeding unit for feeding out the recording media in the sheet cassette 31 one by one. The paper feed roller 32 has a one way clutch function in a manner similar to that of the paper feed roller 13.

Figure 2:
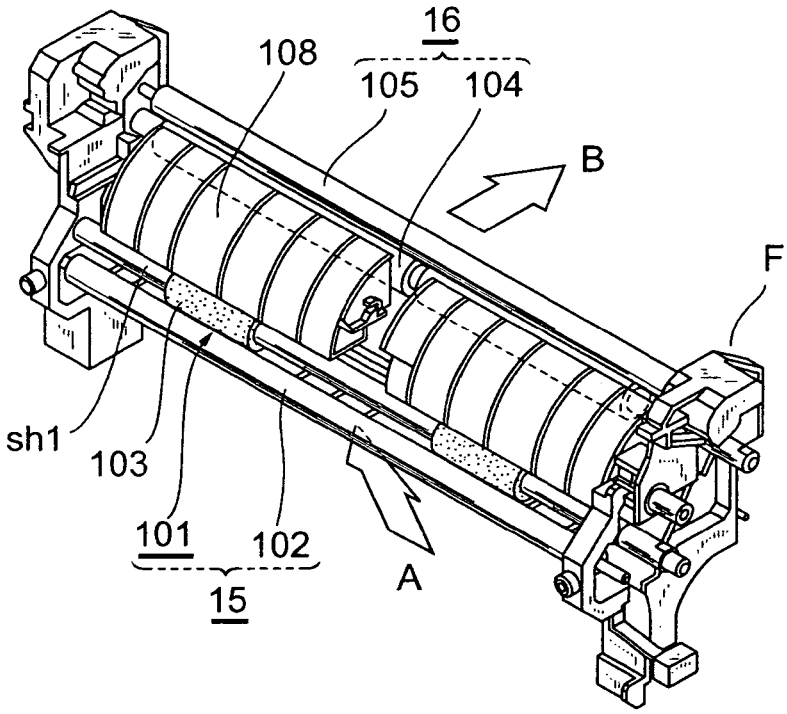
FIG. 2 PRIOR ART
FIG. 2 is a perspective view showing a main section of a conventional medium conveying apparatus.
Figure 3:
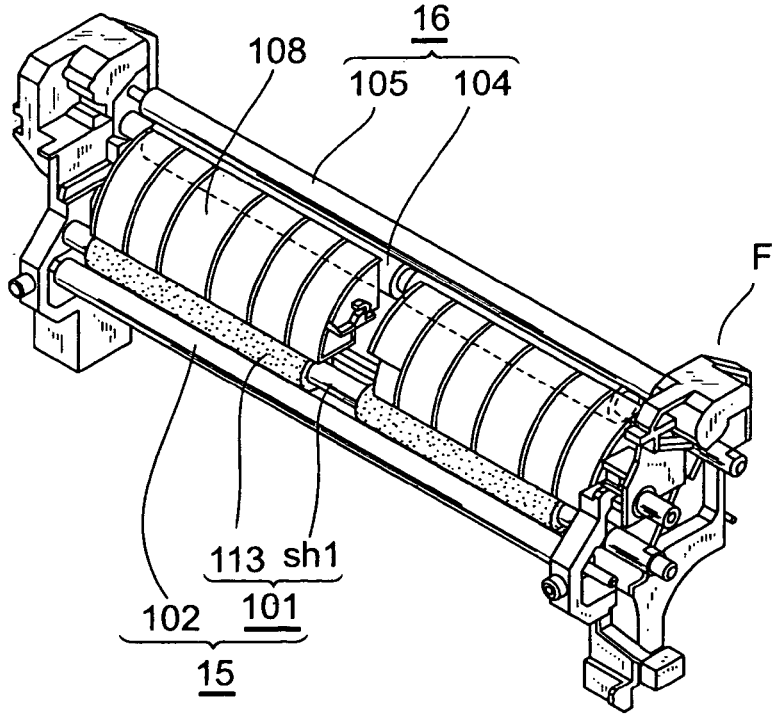
FIG. 3 PRIOR ART
FIG. 3 is a perspective view showing a main section of another conventional medium conveying apparatus.

The first conveying roller unit 45 is arranged on the downstream side from the paper feed rollers 13 and 32 and constructs the first conveying unit. The second conveying roller unit 16 is arranged on the downstream side from the first conveying roller unit 45 and constructs the second conveying unit. The first conveying roller unit 45 has a conveying roller 121 and a pinch roller 122 pressed to the conveying roller 121 by a spring (not shown). The second conveying roller unit 16 has the conveying roller 104 and the pinch roller 105 pressed to the conveying roller 104 by a spring (not shown). An electromagnetic clutch (not shown) is arranged coaxially with the first conveying roller unit 45. By turning on/off (engaging/disengaging) the electromagnetic clutch, a rotating force to the first conveying roller unit 45 from the paper feed motor is propagated or disconnected. Since the conveying roller 121 has a small structure in a manner similar to the rubber roller 103 shown in FIG. 2, an amount of rubber which is used can be reduced.

Each image forming unit 18 has a photosensitive drum 112 as an image holding member, a transfer roller 115 as a transfer apparatus arranged so as to face the photosensitive drum 112, and the like in order to form a visible toner image of each color by thermally meltable toner of each color and transfer it onto the recording medium. A transfer belt 114 is arranged between the photosensitive drum 112 and the transfer roller 115 so that it can run freely. When the recording medium is conveyed on the transfer belt 114, the toner images are transferred onto the recording medium.

Reference numeral 19 denotes a fixing unit for fixing the color toner images formed by the image forming units 18 onto the recording medium, thereby forming a color image. The fixing unit 19 has a heat roller 116 and a pressing roller 118. Reference numeral 20 denotes an ejecting roller unit for ejecting out the recording medium to the outside from the printer main body 11 and 21 indicates a running route of the recording medium in the case where the paper is fed out of the sheet cassette 12 mounted in the printer main body 11.

Further, reference numeral 33 denotes a medium sensor as a third detecting unit serving as an optional medium front edge detecting unit for detecting a front edge of the recording medium in order to recognize the passage of the recording medium and 34 indicates an optional conveying roller unit having functions of conveying the recording medium fed out of the sheet cassette 31 and correcting the skew of the recording medium. The conveying roller unit 34 constructs the third conveying unit. An electromagnetic clutch (not shown) is arranged coaxially with the third conveying roller unit 34. By turning on/off (engaging/disengaging) the electromagnetic clutch, the rotating force to the conveying roller unit 34 from the paper feed motor is propagated or disconnected. The conveying roller unit 34 comprises a conveying roller 125 and a pinch roller 35 pressed to the conveying roller unit 34 by a spring (not shown). Reference numeral 36 denotes a running route of the recording medium in the case where the paper is fed out of the optional paper feed tray unit 30. In the printer main body 11, the medium conveying apparatus for conveying the recording medium is constructed by the paper feed roller 13, the first conveying roller unit 45, the second conveying roller unit 16, and the like. In the optional paper feed tray unit 30, the medium conveying apparatus for conveying the recording medium is constructed by the paper feed roller 32, the conveying roller unit 34, and the like.

A control apparatus of the printer will now be described.

Figure 5:
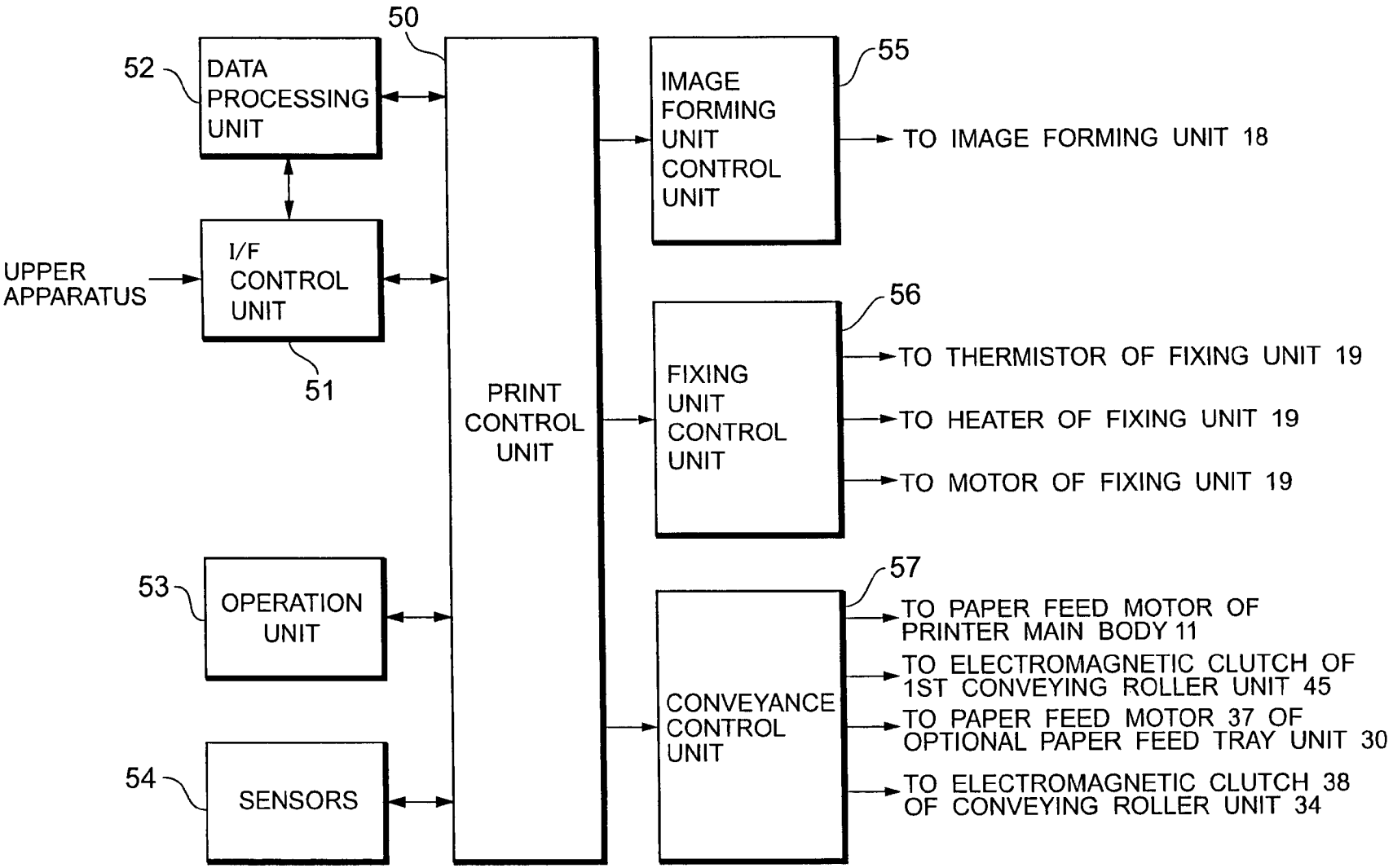
FIG. 5 is a block diagram of a control apparatus of the printer in the first embodiment of the invention.

FIG. 5 is a block diagram of the control apparatus of the printer in the first embodiment of the invention.

In the diagram, reference numeral 50 denotes a print control unit comprising a microprocessor, a ROM, a RAM, input/output ports, a timer, and the like (not shown). The print control unit 50 receives print data and a control command from an upper apparatus, controls the whole printer, and executes the printing operation.

Reference numeral 51 denotes an interface (I/F) control unit for transmitting printer information to the upper apparatus, analyzing control commands transmitted from an upper apparatus, and processing the print data transmitted from the upper apparatus; 52 a data processing unit for converting the print data into an image signal necessary in an image forming unit control unit 55; 53 an operation unit comprising a display device such as LED or LCD (not shown) for displaying a state of the printer and switches for giving instructions to the printer from the operator; and 54 various sensors to detect a status of the medium conveying apparatus for conveying the recording medium and states such as temperature, humidity, and the like in the printer main body 11 (FIG. 4). Outputs of the sensors 54 are sent to the print control unit 50.

Reference numeral 55 denotes the image forming unit control unit for controlling each image forming unit 18 and 56 indicates a fixing unit control unit for controlling the fixing unit 19. The fixing unit control unit 56 detects a temperature of the heat roller 116 by a thermistor on the basis of an instruction of the print control unit 50, controls the on/off operations of a heater built in the heat roller 116, keeps the heat roller 116 at a predetermined temperature, and controls a motor to rotate the heat roller 116 and the pressing roller 118.

Reference numeral 57 denotes a conveyance control unit for driving a paper feed motor of the printer main body 11, turning on/off the electromagnetic clutch of the first conveying roller unit 45, driving a paper feed motor of the optional paper feed tray unit 30, and turning on/off the electromagnetic clutch of the conveying roller unit 34.

The operation of the printer with the above construction will now be described.

First, when the print control unit 50 receives the control command and the print data transmitted from the upper apparatus through the interface control unit 51, it issues an instruction to the fixing unit control unit 56 and allows the heater to start heating. When the temperature of the heat roller 116 rises to a predetermined temperature, the fixing unit control unit 56 issues an instruction to the motor of the fixing unit 19 and drives the motor so as to rotate the heat roller 116 and the pressing roller 118.

Subsequently, the print control unit 50 discriminates a type of recording media enclosed on the sheet cassette 12 on the basis of sensor outputs of a sheet residual amount sensor as a medium residual amount detecting unit and a sheet size sensor as a medium size detecting unit and issues an instruction to the conveyance control unit 57 in order to start the conveyance of the recording medium according to the type of recording medium.

Subsequently, the recording medium fed out of the sheet cassette 12 is conveyed to the image forming unit 18 through the first conveying roller unit 45, the guide 108, and the second conveying roller unit 16. In the image forming unit 18, electrophotographic processes such as charging, exposure, development, transfer, and the like are executed on the basis of the image signal converted by the data processing unit 52 and the toner image is transferred onto the recording medium.

In the fixing unit 19, the recording medium onto which the toner image has been transferred passes between the heat roller 116 and the pressing roller 118. The toner image is fixed onto the recording medium by the heat of the heat roller 116. Subsequently, the recording medium onto which the toner image has been fixed is further conveyed and ejected to the outside of the printer through the ejecting roller unit 20.

The medium conveying apparatus for conveying the recording medium in the printer main body 11 and the optional paper feed tray unit 30 will now be described. In the embodiment, since the structure of the medium conveying apparatus for conveying the recording medium in the printer main body 11 and that of the medium conveying apparatus for conveying the recording medium in the optional paper feed tray unit 30 are the same, only the medium conveying apparatus for conveying the recording medium in the optional paper feed tray unit 30 will now be described.

Figure 6:
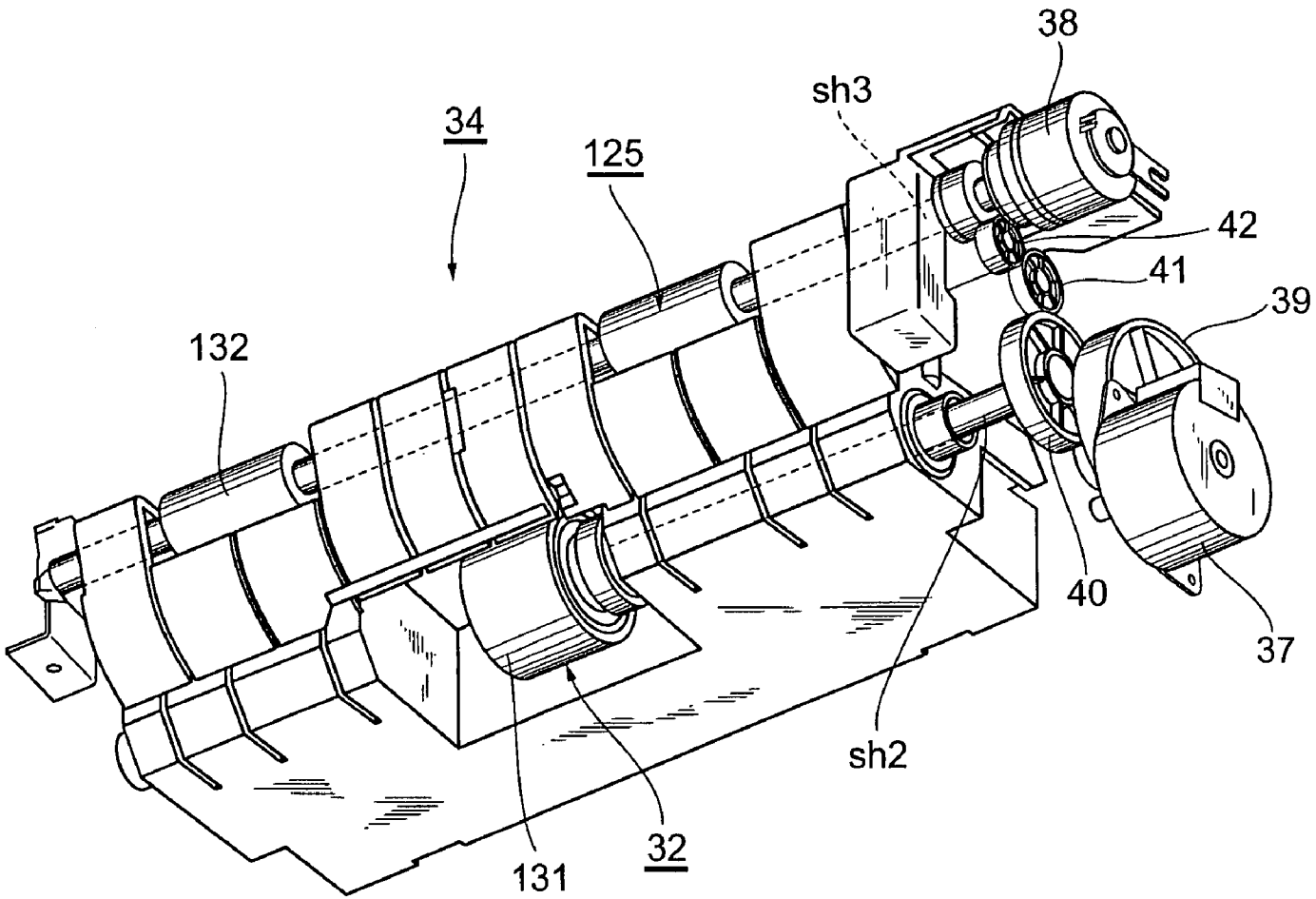
FIG. 6 is a perspective view of the medium conveying apparatus for conveying a recording medium in an optional paper feed tray unit in the first embodiment of the invention.

FIG. 6 is a perspective view of the medium conveying apparatus for conveying the recording medium in the optional paper feed tray unit in the first embodiment of the invention.

As shown in the diagram, an output shaft (not shown) of a paper feed motor 37 as a driving unit for paper feeding is coupled with the paper feed roller 32 through gears 39 and 40 and, further, coupled with the conveying roller 125 through gears 41 and 42. The paper feed roller 32 has a shaft sh2 and a rubber roller 131. An electromagnetic clutch 38 is arranged coaxially with the conveying roller 125. By turning on/off the electromagnetic clutch 38, the rotating force to the conveying roller 125 from the paper feed motor 37 is propagated or disconnected. The conveying roller 125 comprises a shaft sh3 and a rubber roller 132.

When the recording medium is fed into the printer main body 11 from the optional paper feed tray unit 30 (FIG. 4), if the driving of the paper feed motor 37 is immediately stopped after the front edge of the recording medium reaches the first conveying roller unit 45, the first conveying roller unit 45 fetches the recording medium into the printer main body 11 while receiving loads which are applied by a separating member, the paper feed roller 32, the conveying roller unit 34, and the like of the optional paper feed tray unit 30 side. Therefore, a sufficient conveying force cannot be assured in the first conveying roller unit 45.

In the embodiment, therefore, even after the front edge of the recording medium reached the first conveying roller unit 45, the driving of the paper feed motor 37 is also continued, thereby enabling the recording medium to be smoothly conveyed in the first conveying roller unit 45.

Figure 1:
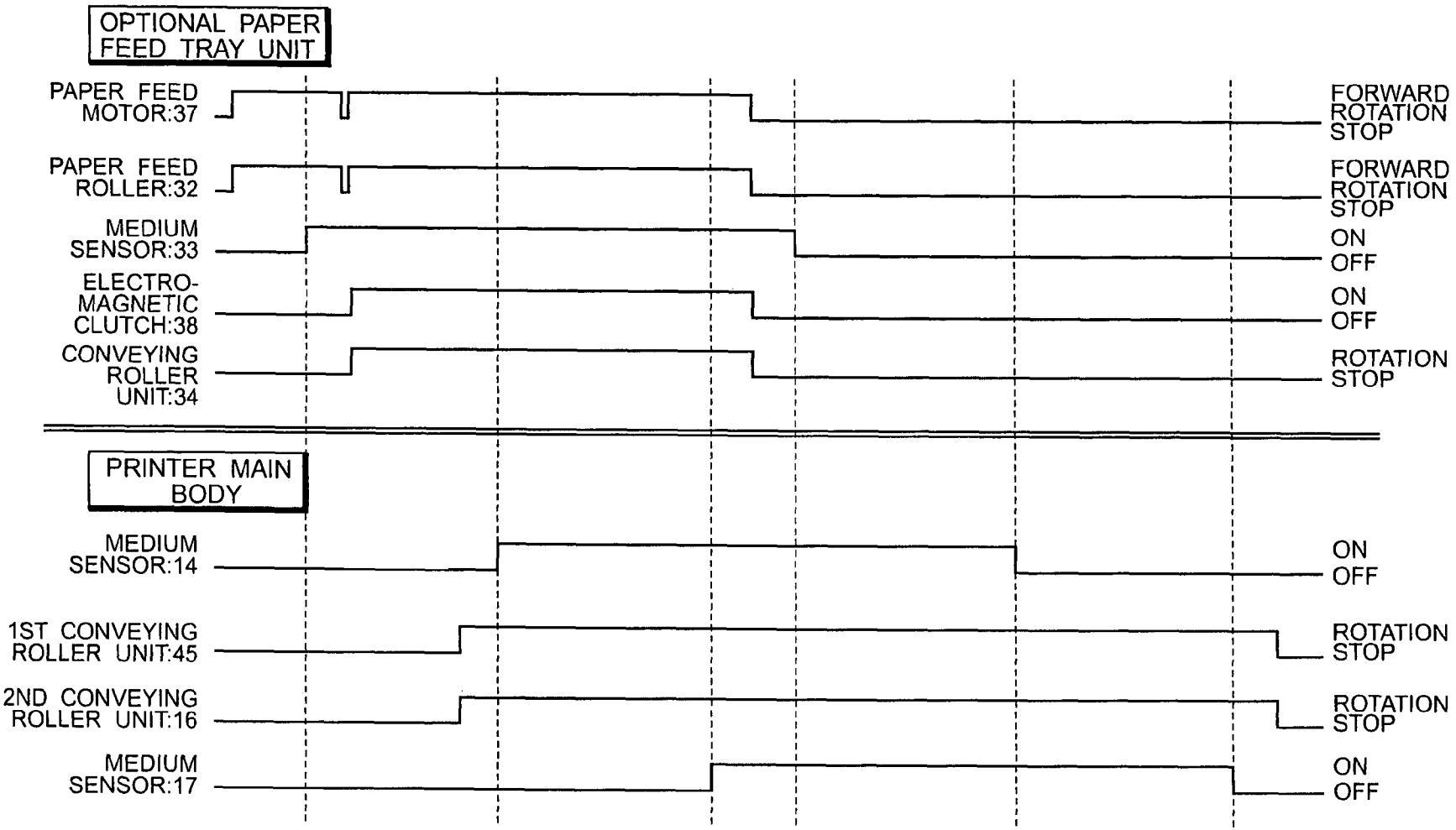
FIG. 1 is a time chart showing the operation of a medium conveying apparatus in the first embodiment of the invention.

FIG. 1 is a time chart showing the operation of the medium conveying apparatus in the first embodiment of the invention.

First, when the recording medium is fed into the printer main body 11 from the optional paper feed tray unit 30 (FIG. 4), the conveyance control unit 57 (FIG. 5) drives the paper feed motor 37 (FIG. 6) so as to rotate the paper feed roller 32. The recording media enclosed on the sheet cassette 31 of the optional paper feed tray unit 30 are fed out one by one by the paper feed roller 32. At this time, since the electromagnetic clutch 38 is OFF (has been disconnected), the front edge of the fed-out recording medium is abutted on the conveying roller unit 34 and temporarily stopped, so that the skew is corrected. Subsequently, the conveyance control unit 57 turns on the electromagnetic clutch 38 so that the rotating force generated by the paper feed motor 37 is propagated to the conveying roller unit 34, thereby rotating the paper feed roller 32 and the conveying roller unit 34 and feeding the recording medium into the printer main body 11. In association with it, the conveyance control unit 57 drives the paper feed motor of the printer main body 11 at predetermined timing, thereby rotating the first and second conveying roller units 45 and 16. Thus, the recording medium is conveyed by the paper feed roller 32, the conveying roller unit 34, and the first conveying roller unit 45.

When the recording medium subsequently reaches the second conveying roller unit 16 and the medium sensor 17 detects the front edge of the recording medium and is turned on, the conveying force by the second conveying roller unit 16 can be used. Therefore, paper feeding unit operation stop processing means which serves as a operation stopping unit of the conveyance control unit 57 executes a paper feeding unit operation stopping process, stops the operations of the paper feed roller 32 and the conveying roller unit 34, stops the driving of the paper feed motor 37, and turns off the electromagnetic clutch 38 at predetermined timing, in the embodiment, after the front edge of the recording medium passed through the second conveying roller unit 16. Therefore, the paper feed roller 32 is raced by the built-in one-way clutch and the conveying roller unit 34 is raced due to the turn-off of the electromagnetic clutch 38, respectively. The recording medium is conveyed by the first and second conveying roller units 45 and 16 and fed to the image forming unit 18.

As mentioned above, according to the embodiment, for a period of time until the recording medium reaches the second conveying roller unit 16 after it reached the first conveying roller unit 45, the paper feed roller 32 and the conveying roller unit 34 are rotated and the recording medium is pushed from behind by the paper feed roller 32 and the conveying roller unit 34, so that the recording medium can be conveyed by the paper feed roller 32, the conveying roller unit 34, and the first conveying roller unit 45. Therefore, for the period of time until the recording medium reaches the second conveying roller unit 16, the load of the optional paper feed tray unit 30 side which is applied to the first conveying roller unit 45 can be reduced. After the recording medium reached the second conveying roller unit 16, the load of the optional paper feed tray unit 30 side can be distributed by the first and second conveying roller units 45 and 16. Thus, the recording medium can be smoothly conveyed by the first conveying roller unit 45.

Since the load which is applied to the first conveying roller unit 45 can be reduced, there is no need to enlarge the rubber roller (not shown) of the conveying roller 121. Thus, the costs of the medium conveying apparatus can be reduced.

In the first embodiment, on the other hand, for the period of time until the front edge of the recording medium reaches the second conveying roller unit 16, the paper feed roller 32 and the conveying roller unit 34 need to be rotated on the optional paper feed tray unit 30 side. Therefore, when the recording medium is short, even if the feed-out of the recording medium is finished, the paper feed roller 32 continues to rotate and the next recording medium is fed out. Consequently, restriction occurs in the sheet size as a medium size.

The second embodiment of the invention will now be described. Component elements having the same structures as those of the first embodiment are designated by the same reference numerals and their detailed description is omitted. Since the second embodiment has substantially the same structure, effects similar to those in the first embodiment are also obtained.

Figure 7:
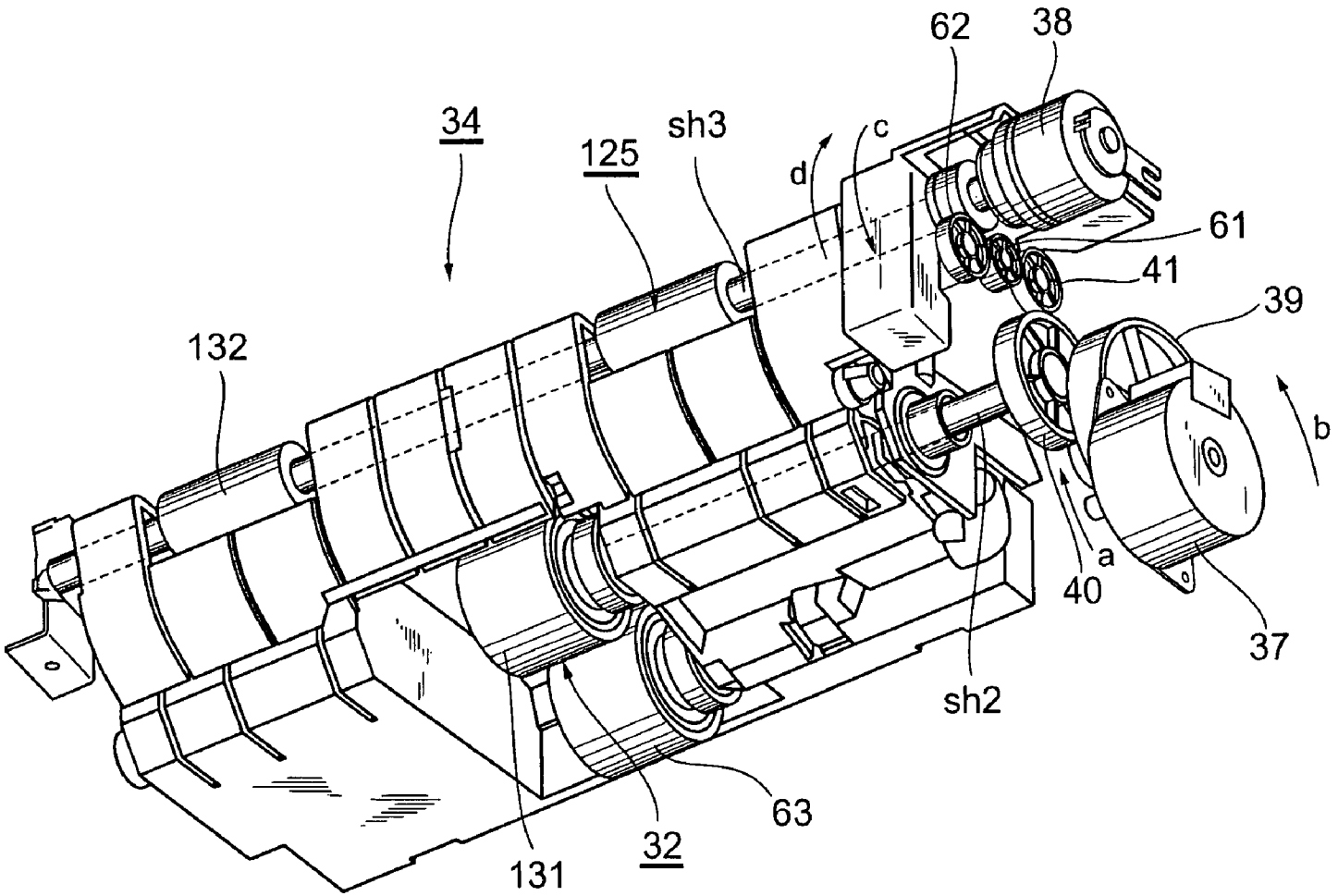
FIG. 7 is a perspective view of a medium conveying apparatus for conveying a recording medium in an optional paper feed tray unit in the second embodiment of the invention.

FIG. 7 is a perspective view of the medium conveying apparatus for conveying the recording medium in an optional paper feed tray unit in the second embodiment of the invention.

As shown in the diagram, the electromagnetic clutch 38 is arranged coaxially with the conveying roller 125 in the conveying roller unit 34 constructing the third conveying unit. By turning on/off the electromagnetic clutch 38, the rotating force to the conveying roller 125 from the paper feed motor 37 as a driving unit for the paper feeding can be propagated or disconnected. A planet gear 61 is arranged between the paper feed roller 32 as a second paper feeding unit and the conveying roller 125 so as to be movable in the directions shown by arrows c and d. When the paper feed motor 37 is forwardly rotated (driven in the direction shown by an arrow a), the planet gear 61 is moved in the direction shown by the arrow c and come into engagement with a gear 62. The rotating force generated by the paper feed motor 37 is propagated to the gear 62 through the gears 39 to 41 and the planet gear 61. On the other hand, when the paper feed motor 37 is reversely rotated (driven in the direction shown by an arrow b), the planet gear 61 is driven in the direction shown by the arrow d and come into engagement with a gear of the electromagnetic clutch 38. The rotating force generated by the paper feed motor 37 is propagated to the electromagnetic clutch 38 through the gears 39 to 41 and the planet gear 61. By turning on/off the electromagnetic clutch 38, the rotating force is selectively propagated from the paper feed motor 37 only to the paper feed roller 32, only to the conveying roller unit 34, or to both of the paper feed roller 32 and the conveying roller unit 34. Reference numeral 63 denotes a subroller which is arranged in contact with the paper feed roller 32 and assists the conveyance of the recording medium.

Figure 8:
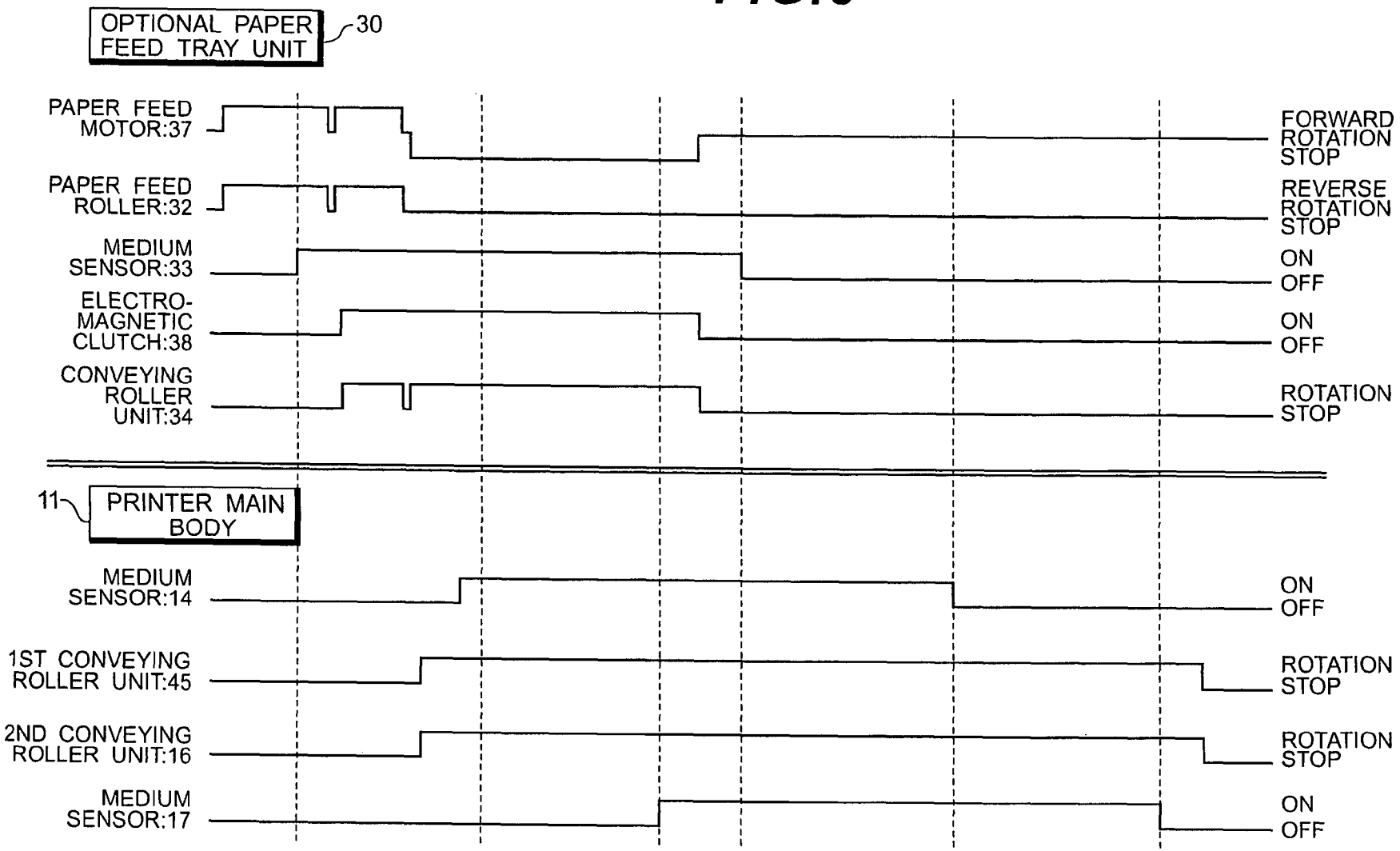
FIG. 8 is a time chart showing the operation of the medium conveying apparatus in the second embodiment of the invention.

FIG. 8 is a time chart showing the operation of the medium conveying apparatus in the second embodiment of the invention.

First, when the recording medium is fed into the printer main body 11 from the optional paper feed tray unit 30 (FIG. 4), the conveyance control unit 57 (FIG. 5) drives the paper feed motor 37 (FIG. 7) so as to rotate the paper feed roller 32, so that the recording media enclosed on the sheet cassette 31 as a recording medium enclosing unit are fed out one by one. At this time, since the electromagnetic clutch 38 is OFF, the front edge of the fed-out recording medium is abutted on the conveying roller unit 34 and temporarily stopped, so that the skew is corrected. Subsequently, the conveyance control unit 57 turns on the electromagnetic clutch 38 so as to forwardly rotate the paper feed motor 37. The rotating force generated by the paper feed motor 37 is propagated to the conveying roller unit 34, thereby rotating the paper feed roller 32 and the conveying roller unit 34 and conveying the recording medium by an arbitrary short distance.

As mentioned above, when the recording medium passes through the conveying roller unit 34, the paper feeding unit operation stop processing means of the conveyance control unit 57 reversely rotates the paper feed motor 37. At this time, the operation of the paper feed roller 32 is stopped and raced by the one-way clutch. Only the conveying roller unit 34 is rotated, thereby feeding the recording medium into the printer main body 11.

In association with it, the conveyance control unit 57 drives the paper feed motor of the printer main body 11, thereby rotating the first and second conveying roller units 45 and 16 constructing the first and second conveying units. Thus, the recording medium is conveyed by the conveying roller unit 34 and the first conveying roller unit 45.

When the recording medium subsequently reaches the second conveying roller unit 16 and the medium sensor 17 as a second medium front edge detecting unit detects the front edge of the recording medium and is turned on, the conveying force by the second conveying roller unit 16 can be used. Therefore, the paper feeding unit operation stop processing means stops the driving of the paper feed motor 37 and turns off the electromagnetic clutch 38. Therefore, the operation of the conveying roller unit 34 is stopped and the conveying roller unit 34 is raced due to the turn-off of the electromagnetic clutch 38. The recording medium is conveyed by the first and second conveying roller units 45 and 16 and fed to the image forming unit 18.

As mentioned above, according to the embodiment, the planet gear 61 is arranged near the conveying roller unit 34 and by forwardly or reversely rotating the paper feed motor 37, the recording medium can be pushed from behind by the conveying roller unit 34 until the front edge of the recording medium reaches the second conveying roller unit 16. When the recording medium passes through the conveying roller unit 34, the paper feed motor 37 is stopped. Therefore, if the recording medium is short, after the feed-out of the recording medium was finished, the next recording medium is not fed out. Consequently, a range of the sheet size which can be pushed from behind can be widened.

Further, although the load that is applied to the first conveying roller unit 45 increases by arranging the subroller 63, in the embodiment, the load that is applied to the first conveying roller unit 45 by the subroller 63 can be absorbed by the conveying roller unit 34.

Although the recording medium is pushed from behind until the front edge of the recording medium reaches the second conveying roller unit 16 in the first and second embodiments mentioned above, in the case of a recording medium of a relatively large sheet size (for example; Legal 14 [inches] size or the like), even if the recording medium is pushed from behind until the front edge of the recording medium reaches the second conveying roller unit 16, the load also remains after that.

The third embodiment of the invention will now be described. Since a structure of a medium conveying apparatus in the third embodiment is substantially the same as that of the medium conveying apparatus in the second embodiment, it will be explained also with reference to FIG. 7.

Figure 9:
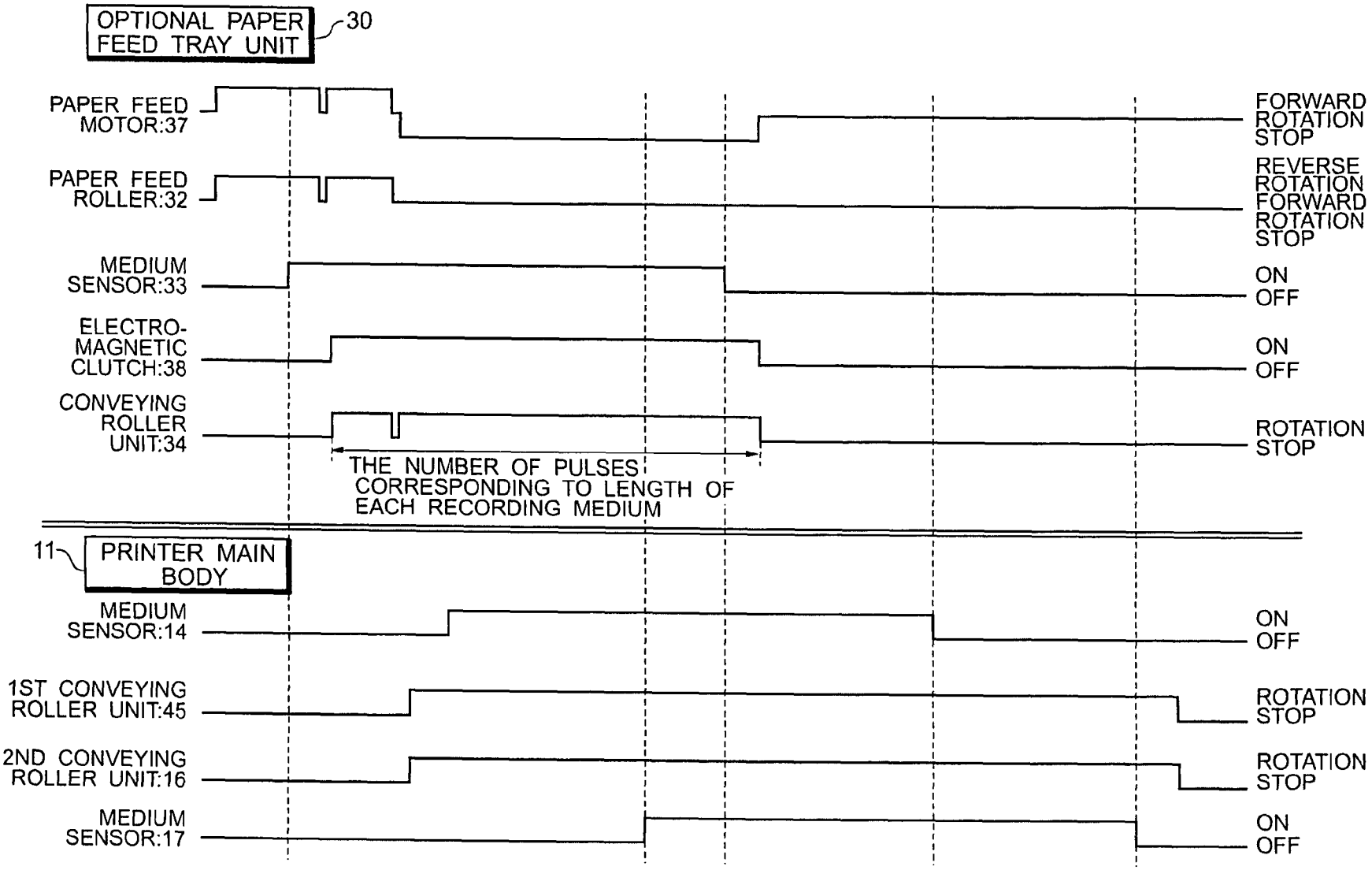
FIG. 9 is a time chart showing the operation of a medium conveying apparatus in the third embodiment of the invention.

FIG. 9 is a time chart showing the operation of the medium conveying apparatus in the third embodiment of the invention.

In this case, a length of recording medium in the conveying direction is detected as a sheet size by the sheet size sensor as a medium length detecting unit and sent to the conveyance control unit 57 through the print control unit 50 (FIG. 5). The number of pulses corresponding to the length of the detected sheet size is set into a counter of the conveyance control unit 57. The operator can also manually input the pulse number without detecting the sheet size.

First, when the recording medium is fed into the printer main body 11 from the optional paper feed tray unit 30 (FIG. 4), the conveyance control unit 57 drives the paper feed motor 37 as a driving unit for the paper feeding and rotates the paper feed roller 32 as a second paper feeding unit, thereby feeding out the recording media enclosed on the sheet cassette 31 as a recording medium enclosing unit. At this time, since the electromagnetic clutch 38 is OFF, the front edge of the fed-out recording medium is abutted on the conveying roller unit 34 constructing the third conveying unit and temporarily stopped, so that the skew is corrected. Subsequently, the conveyance control unit 57 turns on the electromagnetic clutch 38 so as to forwardly rotate the paper feed motor 37. The rotating force generated by the paper feed motor 37 is propagated to the conveying roller unit 34, thereby rotating the paper feed roller 32 and the conveying roller unit 34 and conveying the recording medium by an arbitrary short distance. In association with the start of the rotation of the conveying roller unit 34, the conveyance control unit 57 starts the counting operation by the counter.

Subsequently, when the paper feeding unit operation stop processing means of the conveyance control unit 57 reversely rotates the paper feed motor 37, the operation of the paper feed roller 32 is stopped by the one-way clutch, the paper feed roller 32 is raced, and only the conveying roller unit 34 is rotated, thereby feeding the recording medium into the printer main body 11.

In association with it, the conveyance control unit 57 drives the paper feed motor of the printer main body 11 and rotates the first and second conveying roller units 45 and 16 constructing the first and second conveying units, so that the recording medium is conveyed by the conveying roller unit 34 and the first conveying roller unit 45.

Subsequently, when the recording medium reaches the second conveying roller unit 16 and the medium sensor 17 as a second medium front edge detecting unit detects the front edge of the recording medium and is turned on, the conveying force by the second conveying roller unit 16 can be used. However, the apparatus enters the standby mode until a count value of the counter is equal to the number of pulses set every recording medium. When the count value is equal to the number of pulses set every recording medium and the recording medium is conveyed by the distance corresponding to the length of sheet size, the paper feeding unit operation stop processing means stops the driving of the paper feed motor 37 and turns off the electromagnetic clutch 38. Therefore, the operation of the conveying roller unit 34 is stopped due to the turn-off of the electromagnetic clutch 38 and the conveying roller unit 34 is raced. The recording medium is conveyed by the first and second conveying roller units 45 and 16 and fed to the image forming unit 18.

As mentioned above, according to the embodiment, since the driving of the paper feed motor 37 can be continued for a period of time corresponding to the sheet size, even in the case of a recording medium of a relatively large sheet size, the recording medium can be sufficiently pushed from behind.

In the embodiment, since the number of pulses is set on the basis of the sheet size, there is a case where a slip occurs during the conveyance of the recording medium due to not only the type, thickness, stiffness, surface state, and the like of the recording medium but also ambient environments (temperature, humidity, etc.) and a conveyance error occurs. In such a case, a conveyance amount of the recording medium is smaller than a presumed amount.

Therefore, the fourth embodiment of the invention in which the recording medium can be accurately conveyed by the distance corresponding to the presumed amount will now be described. Since a structure of a medium conveying apparatus in the fourth embodiment is substantially the same as that of the medium conveying apparatus in the second embodiment, it will be explained also with reference to FIG. 7.

Figure 10:
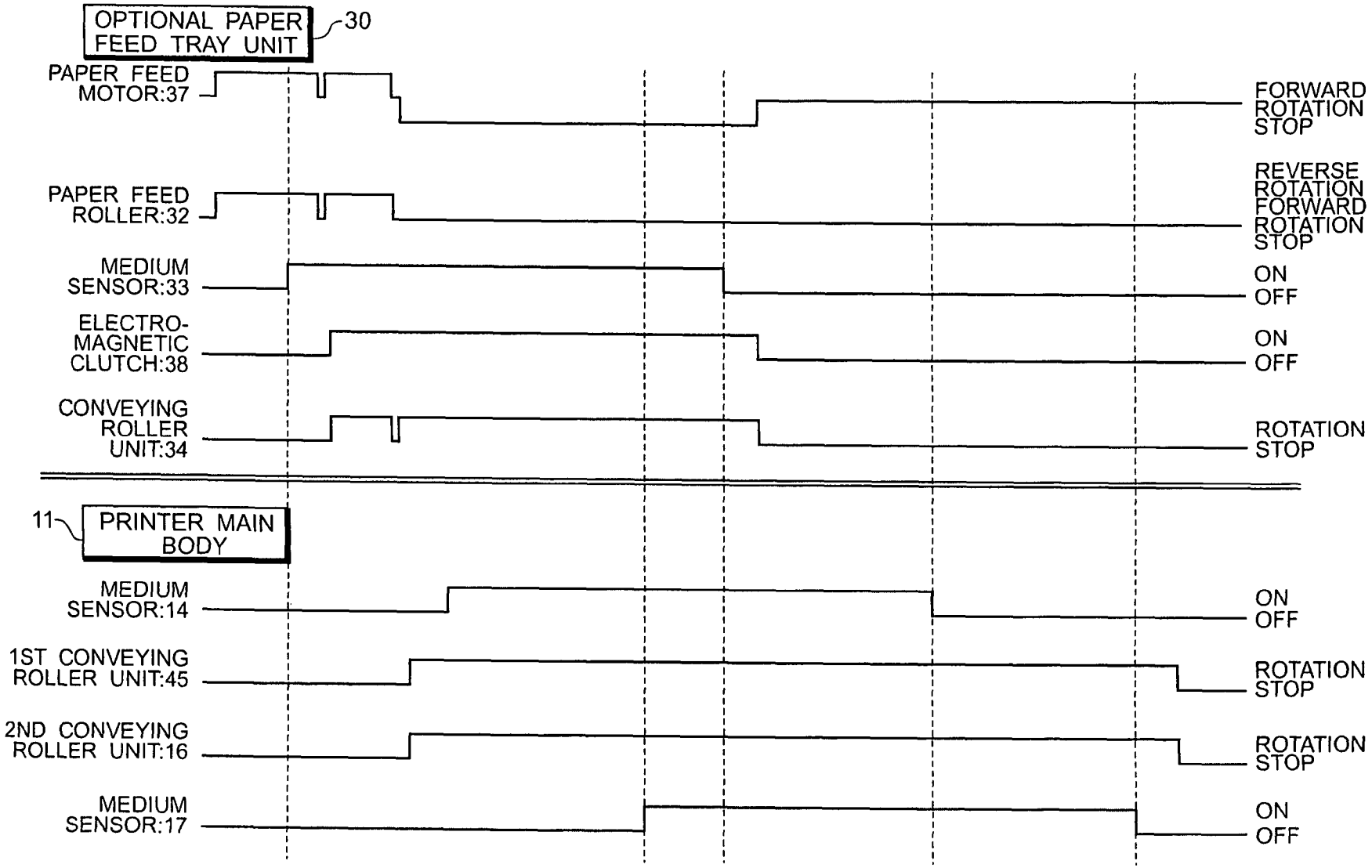
FIG. 10 is a time chart showing the operation of a medium conveying apparatus in the fourth embodiment of the invention.

FIG. 10 is a time chart showing the operation of the medium conveying apparatus in the fourth embodiment of the invention.

First, when the recording medium is fed into the printer main body 11 from the optional paper feed tray unit 30 (FIG. 4), the conveyance control unit 57 (FIG. 5) drives the paper feed motor 37 as a driving unit for the paper feeding and rotates the paper feed roller 32 as a second paper feeding unit, thereby feeding out the recording media enclosed on the sheet cassette 31 as a recording medium enclosing unit. At this time, since the electromagnetic clutch 38 is OFF, the front edge of the fed-out recording medium is abutted on the conveying roller unit 34 constructing the third conveying unit and temporarily stopped, so that the skew is corrected. Subsequently, the conveyance control unit 57 turns on the electromagnetic clutch 38 so as to forwardly rotate the paper feed motor 37. The rotating force generated by the paper feed motor 37 is propagated to the conveying roller unit 34, thereby rotating the paper feed roller 32 and the conveying roller unit 34 and conveying the recording medium by an arbitrary short distance.

Subsequently, when the paper feeding unit operation stop processing means of the conveyance control unit 57 reversely rotates the paper feed motor 37, the operation of the paper feed roller 32 is stopped by the one-way clutch, the paper feed roller 32 is raced, and only the conveying roller unit 34 is rotated, thereby feeding the recording medium into the printer main body 11.

In association with it, the conveyance control unit 57 drives the paper feed motor of the printer main body 11 and rotates the first and second conveying roller units 45 and 16 constructing the first and second conveying units, so that the recording medium is conveyed by the conveying roller unit 34 and the first conveying roller unit 45.

Subsequently, until the recording medium passes through the medium sensor 33 serving as an optional medium front edge detecting unit and as a third detecting unit and the medium sensor 33 functions as a medium rear edge detecting unit, detects a rear edge of the recording medium, and is turned off, the paper feeding unit operation stop processing means continues to turn on the electromagnetic clutch 38, continues to reversely rotate the paper feed motor 37, conveys the recording medium by a predetermined distance, in the embodiment, by a distance of ten and a few [mm], turns off the electromagnetic clutch 38 at that timing, and stops the driving of the paper feed motor 37. After that, the recording medium is conveyed by the first and second conveying roller units 45 and 16 and sent to the image forming unit 18.

As mentioned above, in the embodiment, after the rear edge of the recording medium is detected by the medium sensor 33, the recording medium is conveyed only by the first and second conveying roller units 45 and 16. Therefore, the recording medium can be pushed from behind in correspondence to the length of each recording medium irrespective of the slip. Thus, the recording medium can be accurately conveyed by the distance corresponding to the presumed amount.

The fifth embodiment of the invention will now be described. Component elements having the same structures as those of the second embodiment are designated by the same reference numerals and their detailed description is omitted. Since the fifth embodiment has substantially the same structure, effects similar to those in the second embodiment are also obtained.

Figure 11:
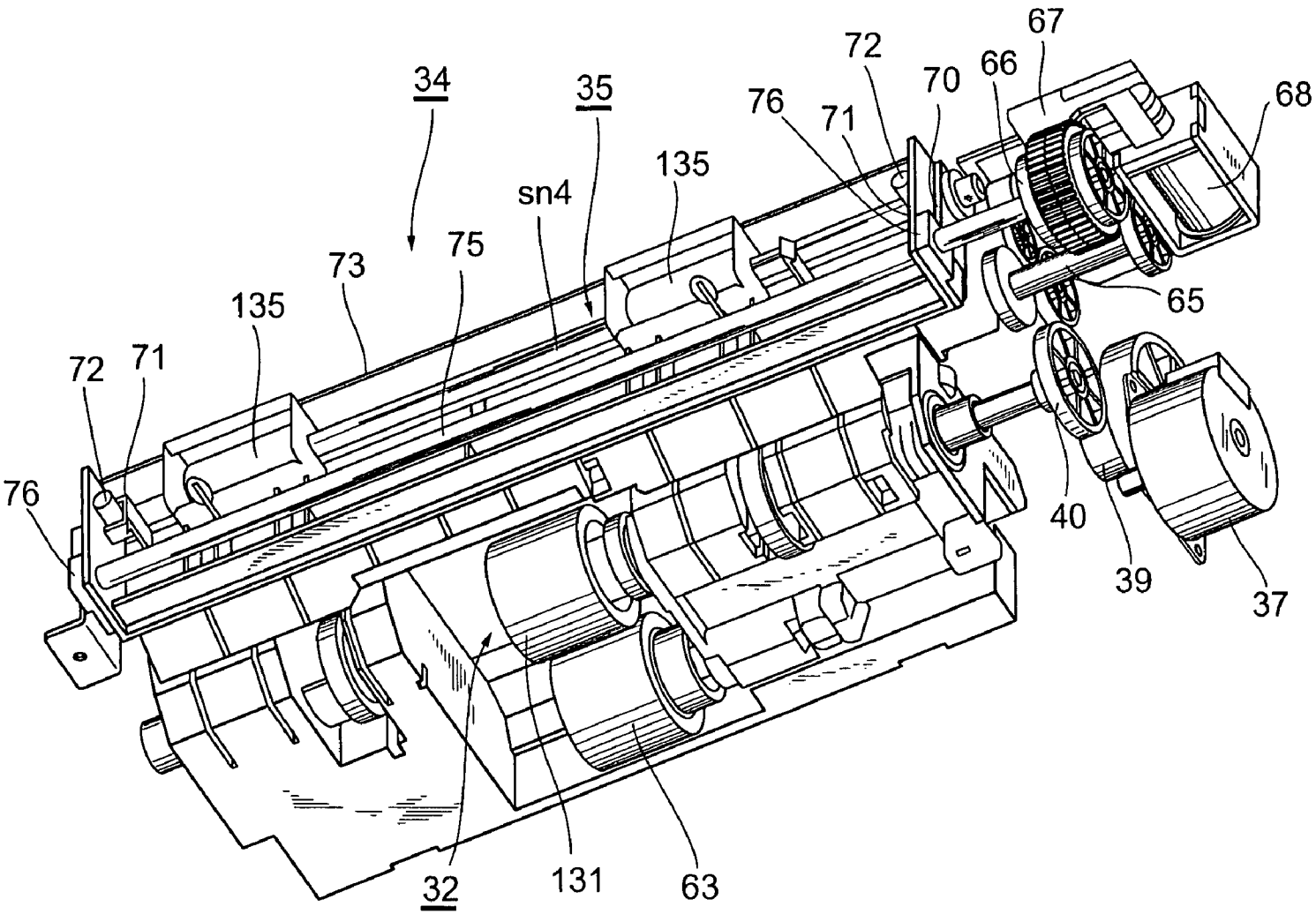
FIG. 11 is a perspective view of a medium conveying apparatus for conveying a recording medium in an optional paper feed tray unit in the fifth embodiment of the invention.
Figure 12:
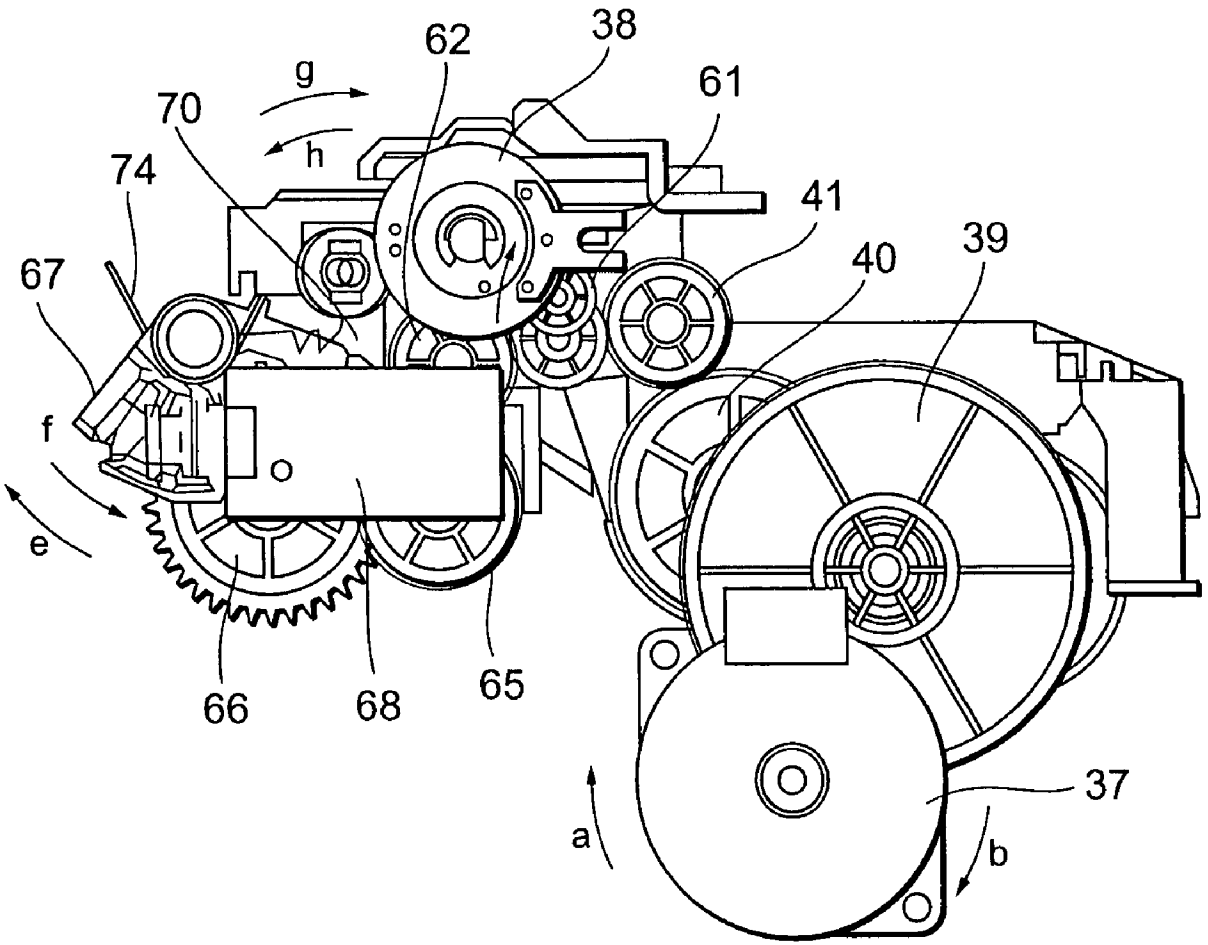
FIG. 12 is a side elevational view of the medium conveying apparatus for conveying the recording medium in the optional paper feed tray unit in the fifth embodiment of the invention.
Figure 13:
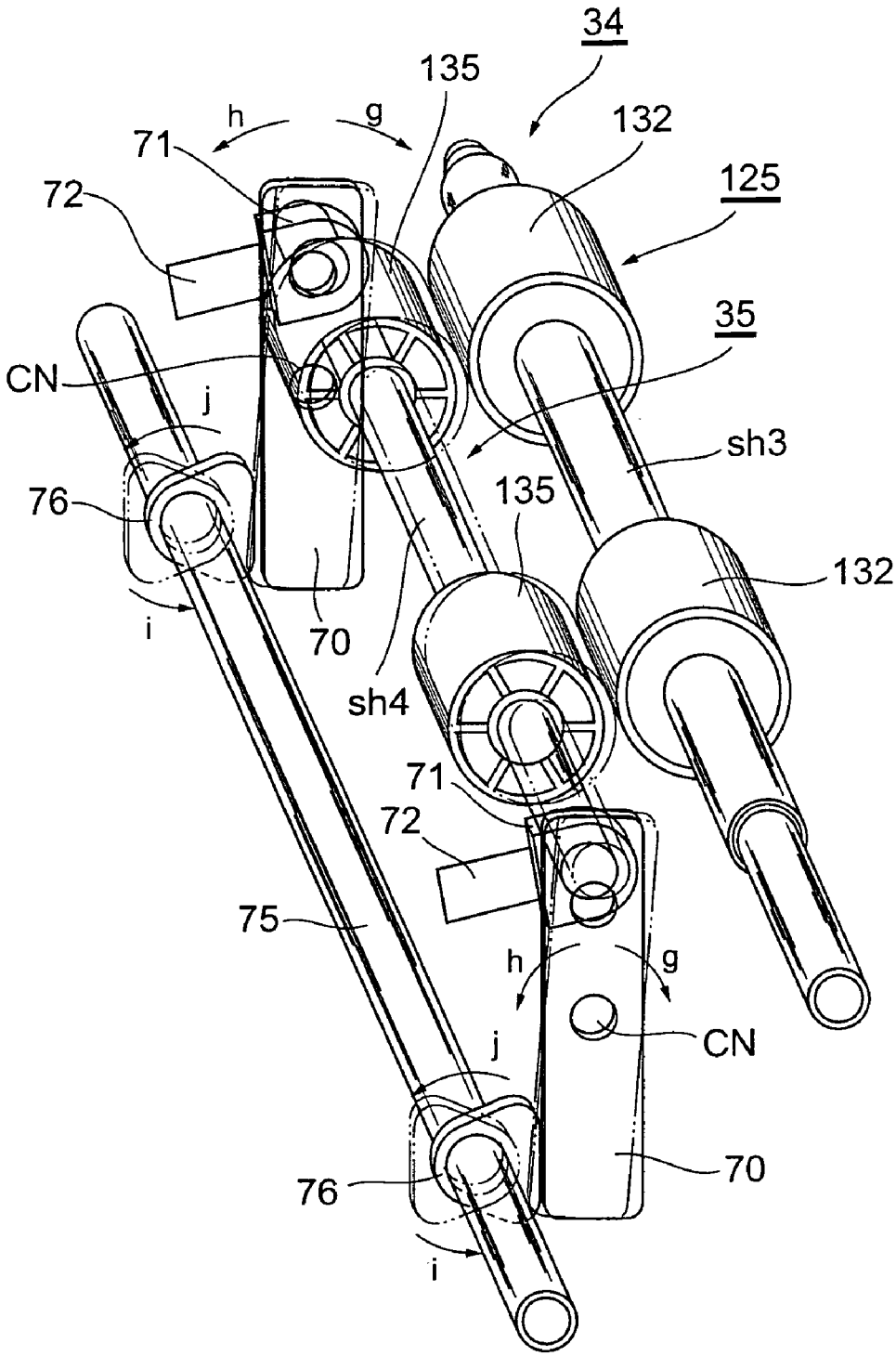
FIG. 13 is a perspective view showing a main section of the medium conveying apparatus for conveying the recording medium in the optional paper feed tray unit in the fifth embodiment of the invention.

FIG. 11 is a perspective view of a medium conveying apparatus for conveying the recording medium in an optional paper feed tray unit in the fifth embodiment of the invention. FIG. 12 is a side elevational view of the medium conveying apparatus for conveying the recording medium in the optional paper feed tray unit in the fifth embodiment of the invention. FIG. 13 is a perspective view showing a main section of the medium conveying apparatus for conveying the recording medium in the optional paper feed tray unit in the fifth embodiment of the invention.

In this case, in a manner similar to the second embodiment of the invention, the electromagnetic clutch 38 is arranged coaxially with the conveying roller 125 as a first roller in the conveying roller unit 34 constructing the third conveying unit and by turning on/off the electromagnetic clutch 38, the rotating force to the conveying roller 125 from the paper feed motor 37 as a driving motor for the paper feeding can be propagated or disconnected. The planet gear 61 is arranged between the paper feed roller 32 as a second paper feeding unit and the conveying roller 125 so as to be movable in the directions shown by the arrows c and d. When the paper feed motor 37 is forwardly rotated (driven in the direction shown by the arrow a), the planet gear 61 is moved in the direction shown by the arrow c and come into engagement with the gear 62. The rotating force generated by the paper feed motor 37 is propagated to the gear 62 through the gears 39 to 41 and the planet gear 61. On the other hand, when the paper feed motor 37 is reversely rotated (driven in the direction shown by the arrow b), the planet gear 61 is driven in the direction shown by the arrow d and come into engagement with a gear of the electromagnetic clutch 38. The rotating force generated by the paper feed motor 37 is propagated to the electromagnetic clutch 38 through the gears 39 to 41 and the planet gear 61. By turning on/off the electromagnetic clutch 38, the rotating force is selectively propagated from the paper feed motor 37 only to the paper feed roller 32, only to the conveying roller unit 34, or to both of the paper feed roller 32 and the conveying roller unit 34. The rotating force is propagated to a clutch 66 through a reduction gear 65 by using the rotating force which is propagated from the paper feed motor 37 to the gear 62.

The pinch roller 35 has a shaft sh4 and a rubber roller 135 and is supported by a frame guide 73 (which is guided by long holes formed in a plurality of positions). Therefore, both sides of the pinch roller 35 is supported by bearings 71 and pressed toward the conveying roller 125 by springs 72 as pressing members.

A link 70 is arranged on the further outside from the bearing 71 of the shaft sh4 and pressed ordinarily in the direction shown by an arrow g by the bearing 71 and the spring 72 while setting a portion CN of the frame guide 73 to a rotational center.

A solenoid lever 67 is pressed ordinarily in the direction shown by an arrow e by a spring 74 as a pressing member. When a solenoid 68 is turned on, the solenoid lever 67 is rotated in the direction shown by an arrow f, propagates the rotating force from the paper feed motor 37 to a shaft 75, and is fixed to the shaft 75. A cam 76 is arranged so as to be rotatable in the directions shown by arrows 1 and j together with the shaft 75. The solenoid lever 67 rotates the cam 76 in the direction shown by the arrow i by about a half turn, thereby rotating the link 70 in the direction shown by an arrow h.

Figure 14:
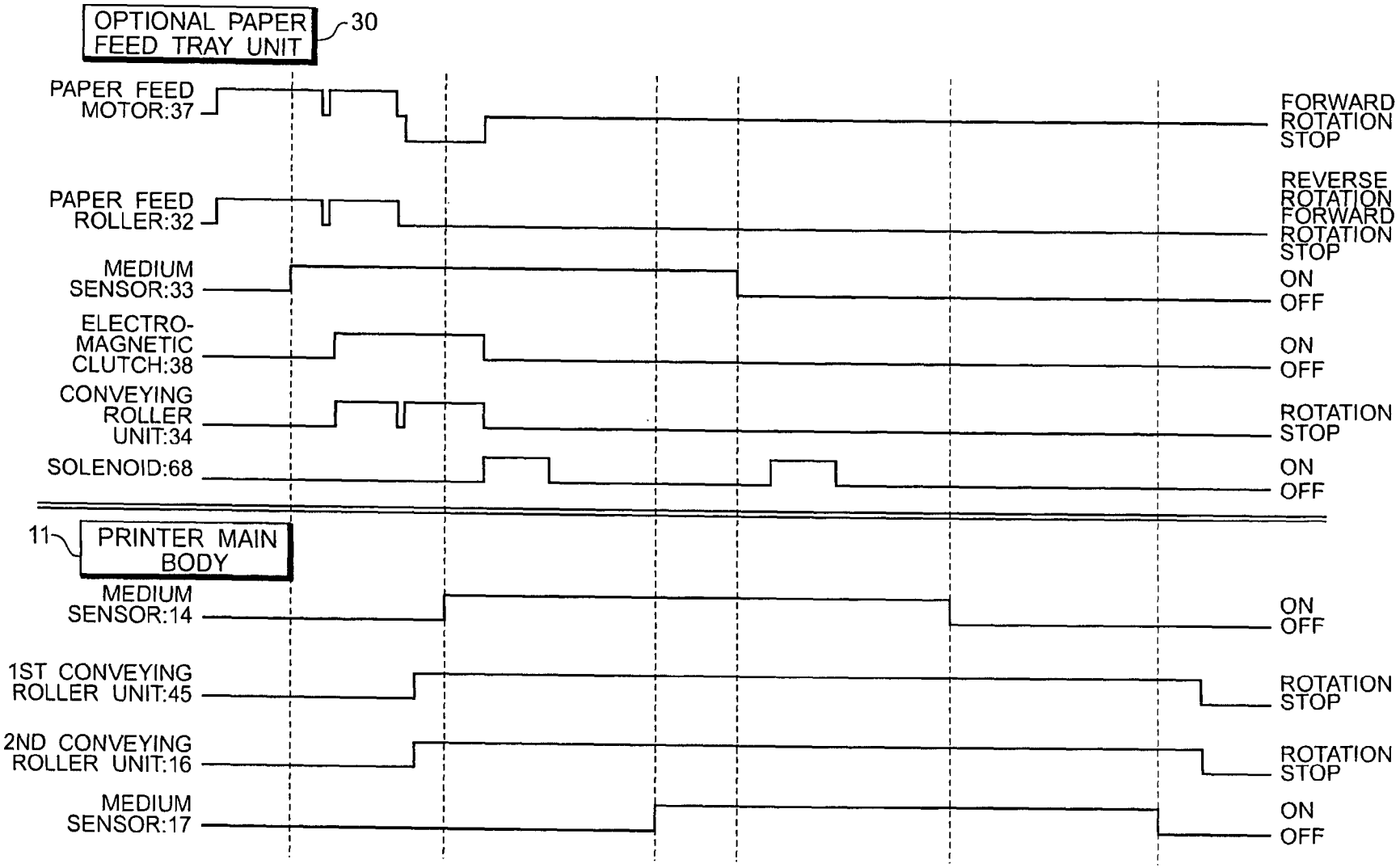
FIG. 14 is a time chart showing the operation of the medium conveying apparatus in the fifth embodiment of the invention.

FIG. 14 is a time chart showing the operation of the medium conveying apparatus in the fifth embodiment of the invention.

First, when the recording medium is fed into the printer main body 11 from the optional paper feed tray unit 30 (FIG. 4), the conveyance control unit 57 (FIG. 5) drives the paper feed motor 37 and rotates the paper feed roller 32, thereby feeding out the recording media enclosed on the sheet cassette 31 as a recording medium enclosing unit. At this time, since the electromagnetic clutch 38 is OFF, the front edge of the fed-out recording medium is abutted on the conveying roller unit 34 and the medium is temporarily stopped, so that the skew is corrected. Subsequently, the conveyance control unit 57 turns on the electromagnetic clutch 38 so as to forwardly rotate the paper feed motor 37. The rotating force generated by the paper feed motor 37 is propagated to the conveying roller unit 34, thereby rotating the paper feed roller 32 and the conveying roller unit 34 and conveying the recording medium by an arbitrary short distance.

Subsequently, when the paper feeding unit operation stop processing means of the conveyance control unit 57 reversely rotates the paper feed motor 37, the paper feed roller 32 is stopped by the one-way clutch and raced, and only the conveying roller unit 34 is rotated, thereby feeding the recording medium into the printer main body 11.

Subsequently, when the front edge of the recording medium reaches the medium sensor 14 as a first medium front edge detecting unit and the medium sensor 14 is turned on and the front edge of the recording medium reaches the first conveying roller unit 45, the paper feeding unit operation stop processing means turns on the solenoid 68 (FIG. 12), thereby rotating the solenoid lever 67 in the direction shown by the arrow f. Thus, the clutch 66 is made operative, the rotating force is propagated to the shaft 75 (FIG. 13), the cam 76 is rotated in the direction shown by the arrow i, and the link 70 is rotated in the direction shown by the arrow h around the portion CN as a rotational center, thereby setting the cam 76 into a state shown by a solid line. At this time, the pressing force by the spring 72 is cancelled, the pinch roller 35 is removed away from the conveying roller 125, and the solenoid 68 is turned off, thereby rotating the solenoid lever 67 in the direction shown by the arrow e. In this manner, the operation of the conveying roller unit 34 is stopped.

The rotation of the cam 76 is controlled on the basis of the number of pulses of the paper feed motor 37 or by a sensor arranged on the shaft 75.

In the state where the pinch roller 35 is away from the conveying roller 125 as mentioned above, the recording medium is conveyed only by the first conveying roller unit 45 and sent to the second conveying roller unit 16.

When the rear edge of the recording medium passes through the medium sensor 33 and the medium sensor 33 is turned off, the conveyance control unit 57 drives the paper feed motor 37 again, turns on the solenoid 68, rotates the cam 76 in the direction shown by the arrow j from the state shown by the solid line, returns the cam 76 to the original position, and stops the paper feed motor 37. Also in this case, the rotation of the cam 76 is controlled on the basis of the number of pulses of the paper feed motor 37 or by the sensor arranged on the shaft 75.

Subsequently, the conveyance control unit 57 drives the paper feed motor 37, rotates the paper feed roller 32, and conveys the next recording medium.

As mentioned above, in the embodiment, since the pinch roller 35 pressed to the conveying roller 125 is constructed as a movable roller, after the recording medium reached the first conveying roller unit 45 in the printer main body 11, the load of the whole optional paper feed tray unit 30 is reduced and the recording medium can be fetched into the printer main body 11 only by the conveying force applied by the first conveying roller unit 45.

Although one optional paper feed tray unit 30 is attached to the printer main body 11 in each of the foregoing embodiments, a plurality of optional paper feed tray units can be also attached.

The present invention is not limited to the foregoing embodiments but many modifications and variations are possible within the spirit and scope of the appended claims of the invention.

What is claimed is:

1. A medium conveying apparatus, comprising:

a record medium enclosing section to enclose record medium;

a paper feeding section to feed out the record medium enclosed in the record medium enclosing section;

a first conveying section that is furnished at a downstream side of the paper feeding section and is used for conveying the record medium, the first conveying section including a pair of first conveying rollers;

a second conveying section that is furnished at a downstream side of the first conveying section, the second conveying section including a pair of second conveying rollers;

a third conveying section that is furnished between the paper feeding section and the first conveying section, the third conveying section including a pair of third conveying rollers; and a conveying controlling unit that controls the paper feeding section, the first conveying section, the second conveying section and the third conveying section, wherein the conveying controlling unit is configured to stop the operation of the paper feeding section by stopping the transmission of a driving force that drives the operation of the paper feeding section, when the record medium fed from the paper feeding section reaches the third pair of conveying rollers, to then convey the record medium by the third and first pairs of conveying rollers until the record medium reaches the second pair of conveying rollers, to then stop the operation of the third pair of conveying rollers by stopping the transmission of a driving force that drives the operation of the third pair of conveying rollers, after a front edge of the record medium reaches the second pair of conveying rollers, and to then convey the record medium by the first and second pairs of conveying rollers.

2. The medium conveying apparatus according to claim 1, wherein the first conveying section and the second conveying section are provided in an apparatus body; and the paper feeding section and the third conveying section are provided in a paper feeding unit that is detachably furnished to the apparatus body.

3. The medium conveying apparatus according to claim 2, wherein when the third conveying section starts to convey the record medium, the paper feeding section is driven to rotate by movement of the record medium.

4. The medium conveying apparatus according to claim 3, wherein when the paper feeding section has a one way clutch.

5. The medium conveying apparatus according to claim 4, wherein the third conveying section has an electromagnetic clutch, and starts to convey the record medium when the electromagnetic clutch is turned on.

6. The medium conveying apparatus according to claim 2, further comprising:

a body side paper feeding motor that is controlled by the conveying controlling unit and is used to drive the first and the second conveying sections; and a unit side paper feeding motor that is controlled by the conveying controlling unit and is used to drive the paper feeding section and the third conveying section, wherein the conveying controlling unit drives the unit side paper feeding motor to rotate along a first direction, and controls the paper feeding section and the third conveying section to convey the record medium for a predetermined period after the front edge of the record medium arrived at the third conveying section;

then drives the unit side paper feeding motor to rotate along a second direction, drives the paper feeding section to rotate, and controls the third conveying section to convey the record medium until the front edge of the record medium arrives at the first conveying section;

further drives the body side paper feeding motor after the front edge of the record medium arrives at the first conveying section, and controls the first and the third conveying sections to convey the record medium until the front edge of the record medium arrives at the second conveying section;

furthermore stops the unit side paper feeding motor after the front edge of the record medium arrives at the second conveying section so as to drive the paper feeding section and the third conveying section to rotate, and controls the first and the second conveying sections to convey the record medium.

7. The medium conveying apparatus according to claim 2, wherein the first conveying section and the second conveying section are positioned on a side of the apparatus body.

8. The medium conveying apparatus according to claim 2, wherein the third conveying rollers include a shaft and an elastomeric roller.

9. The medium conveying apparatus according to claim 8, wherein the third conveying rollers include a plurality of elastomeric rollers.

10. The medium conveying apparatus according to claim 9, wherein the plurality of elastomeric rollers are spaced apart about the shaft.

* * * * *